US005934625A

United States Patent [19]

Gotham et al.

[11] Patent Number: 5,934,625

[45] Date of Patent: Aug. 10, 1999

[54] QWERTY KEYBOARD ARTICULATING DOCKING CADDY

[75] Inventors: David R. Gotham; Kevin C. Koek, both of Rochester; Timothy J. White, Webster; Robert Gerenski, Holley, all of N.Y.

[73] Assignee: Eastman Kodak Company, Rochester, N.Y.

[21] Appl. No.: 08/953,938

[22] Filed: Oct. 20, 1997

[51] Int. Cl.[6] ..... B68G 5/00

[52] U.S. Cl. ..... 248/118; 248/918

[58] Field of Search ..... 248/118, 118.1, 248/118.3, 118.5, 918, 346.01; 108/50.01, 92, 93

[56] References Cited

U.S. PATENT DOCUMENTS

| | | | |
|---|---|---|---|
| 2,182,703 | 12/1939 | Rainwater | 108/92 |
| 4,129,746 | 12/1978 | Lambden | 248/118.1 |
| 4,648,574 | 3/1987 | Granlund | 248/918 |
| 5,141,196 | 8/1992 | Arnold et al. | 248/205.2 |
| 5,433,407 | 7/1995 | Rice | 248/118.1 |
| 5,595,428 | 1/1997 | Huang | 248/918 |

*Primary Examiner*—Ramon O. Ramirez
*Assistant Examiner*—Robert Lipcsik
*Attorney, Agent, or Firm*—Lawrence P. Kessler

[57] ABSTRACT

A keyboard caddy positions a keyboard on a top cover of a machine such as a copier. The keyboard caddy includes a pair of rails and a caddy base. The pair of rails have slots and are mounted upon the top cover. The caddy base includes a planar surface upon which the keyboard is positioned; a plurality of side walls between which the keyboard is positioned; and a pair of protrusions extending from a pair of the side walls and slidably engaging the slots of the rails to allow the caddy base to be moved to a selectable one of a plurality of positions relative to the top cover of the copier. The keyboard caddy holds the keyboard on the copier when the top cover is opened and/or pivoted. The keyboard caddy has diverse selectable positions by being movable to provide ease of use for different users.

10 Claims, 4 Drawing Sheets

QWERTY KEYBOARD ARTICULATING DOCKING CADDY

FIELD OF THE INVENTION

This disclosure relates generally to the field of keyboard holders, and in particular to a movable keyboard caddy positioned on a surface of a machine.

BACKGROUND OF THE INVENTION

Keyboard caddies and other keyboard holders are known which allow a keyboard to be moved to and held in different positions on a desk or other furniture to be used with computers.

Computers have been implemented increasingly in machines such as copiers to provide control of the operations of such machines. Such computers typically utilize an input device such as a keyboard in conjunction with a computer mouse to allow a user and/or a service person to operate the machine.

Furthermore, the position of such keyboards affects the efficient operation of the machine. As different users may prefer different configurations of the components of the machine to provide ease of use, a keyboard mounted in a fixed position on a machine generally does not provide such ease of use.

Machines such as copiers typically include access panels and covers which may be opened and/or pivoted to allow a service person to access the components therein.

Accordingly, a need exists for a keyboard holder implemented on a machine such as a copier. Moreover, a need exists for a keyboard holder which provides ease of use for different users. In addition, a need exists for a keyboard holder which holds a keyboard on a machine even when a cover of the machine is opened and/or pivoted.

SUMMARY OF THE INVENTION

It is recognized herein that a keyboard caddy may be implemented on a machine such as a copier to provides ease of use for different users by being movable. The keyboard caddy holds a keyboard on a machine even when a cover of the machine is opened and/or pivoted.

The keyboard caddy positions the keyboard on a top cover of a machine such as a copier, and includes a pair of rails and a caddy base. The pair of rails have slots and are mounted upon the top cover. The caddy base includes a planar surface upon which the keyboard is positioned; a plurality of side walls between which the keyboard is positioned; and a pair of protrusions extending from a pair of the side walls and slidably engaging the slots of the rails to allow the caddy base to be moved to a selectable one of a plurality of positions relative to the top cover of the copier.

The disclosed keyboard caddy thus has diverse selectable positions to provide ease of use for different users, and also holds a keyboard when a cover of the machine is opened and/or pivoted.

BRIEF DESCRIPTION OF THE DRAWINGS

The features of the present invention will become readily apparent and are to be understood by referring to the following detailed description of the preferred embodiments of the present invention, taken in conjunction with the accompanying drawings, in which.

DETAILED DESCRIPTION OF THE INVENTION

Figure 1:
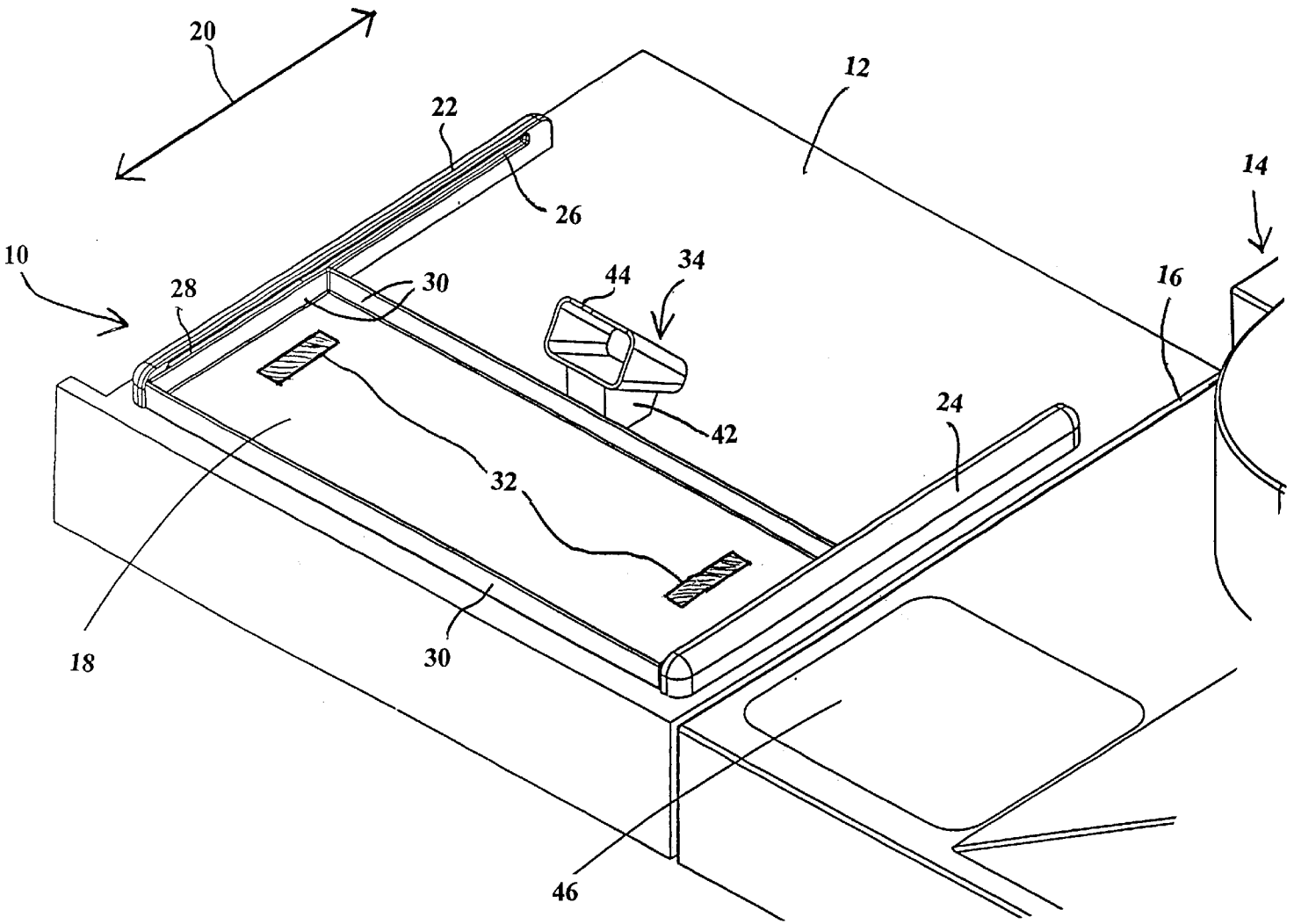
FIG. 1 is a top side perspective view of the disclosed keyboard caddy in a frontward position.

Referring in specific detail to the drawings, with common reference numbers identifying similar or identical elements, steps, and features, as shown in FIG. 1, the present disclosure describes a keyboard caddy 10 affixed to a top cover 12 of a machine. For example, the machine may be a copier 14 operated by a user through a keyboard disposed in the keyboard caddy 10. The copier 14 may have access panels and covers which are opened and/or raised for maintenance and repairs, such as during jam clearance and recovery. Accordingly, the top cover 12 may be pivotally attached to the copier 14, with a gap 16 separating the top cover 12 from other portions of the housing of the copier 14.

The keyboard caddy 10 includes a caddy base 18 and at least one rail upon which the caddy base 18 is articulated in a longitudinal direction parallel to the arrow 20 to be in a selected one of a plurality of longitudinal positions. In a preferred embodiment, the keyboard caddy 10 includes a pair of rails 22, 24 having slots such as the slot 26 in which lateral protrusions of the caddy base 18 are positioned to slide therein. For example, as shown in greater detail in FIG. 2, one side of the caddy base 18 has an elongated protrusion 28 which slidably engages the slot 26 in the rail 22 shown in FIG. 1. It is understood that the other side of the caddy base 18 engaging the rail 24 has a corresponding elongated lateral protrusion positioned within a corresponding slot in the rail 24.

Figure 2:
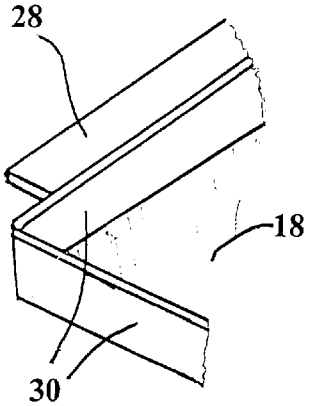
FIG. 2 is an enlarged perspective view of a portion of the keyboard caddy of FIG. 1.

Sliding mechanisms known in the art may be used; for example, the rails 22, 24 may include ball bearings within the slots such as slot 26 to reduce friction with the lateral protrusions of the caddy base 18, such as the elongated protrusion 28 shown in FIG. 2. Alternatively, the lateral protrusions of the caddy base 18 may include tracks with rollers to be positioned within the slot 26. In another alternative embodiment, a ratchet-and-pawl assembly may be included in the sliding mechanism to selectably secure the position of the protrusions within the slots to removably fix the selected position of the caddy base 18 between the rails 22, 24.

The caddy base 18 is configured and dimensioned to have a plurality of side walls 30 extending from a planar surface on which known keyboards may be positioned. In a preferred embodiment, the caddy base 18 with side walls 30 thereof is configured and dimensioned to hold a substantially rectangular-shaped computer keyboard such as a standard QWERTY keyboard. In alternative embodiments, the caddy base 18 may hold keyboards with extended lengths and extra keys such as a 104 key keyboard having specialized keys for using the "MICROSOFT" "WINDOWS 95" graphic user interface. Other non-rectangular keyboards may be accommodated such as the "NATURAL KEYBOARD" available from "MICROSOFT CORPORATION", as well as keyboards with built-in mousepads, trackballs, and touchpads such as the "GLIDEPOINT KEYBOARD" available from "ALPS ELECTRIC". In addition, the caddy base 18 may be configured and dimensioned to hold laptop computers with integrated keyboards which may be operatively connected to the copier 14 for operation by the user. The spacing of the rails 22, 24 is to be set to match the width of the caddy base 18.

A keyboard may rest within the side walls 30 of the caddy base 18, with gravity keeping the keyboard therein during longitudinal motion of the caddy base 18 within the rails, as well as during a predetermined range of angular pivoting of the top cover 12. The caddy base 18 may also include mechanisms for securing the keyboard to the caddy base 18 to insure that the keyboard is retained in the caddy base 18. For example, strips of hook-and-loop fasteners 32 commercially available as "VELCRO" may be placed in the caddy base 18 and/or the planar surface thereof to engage corresponding strips of hook-and-loop fasteners on an underside of the keyboard. The use of hook-and-loop fasteners 32 allows the keyboard to be removably secured to the caddy base 18.

The copier 14 may be operated by a graphic user interface (GUI) using a mouse in conjunction with the keyboard, and so the keyboard caddy 10 may also include a mouse holster 34, as shown in FIG. 1. The mouse holster 34 provides a docking area for the mouse when the mouse is not in use.

Figure 3:
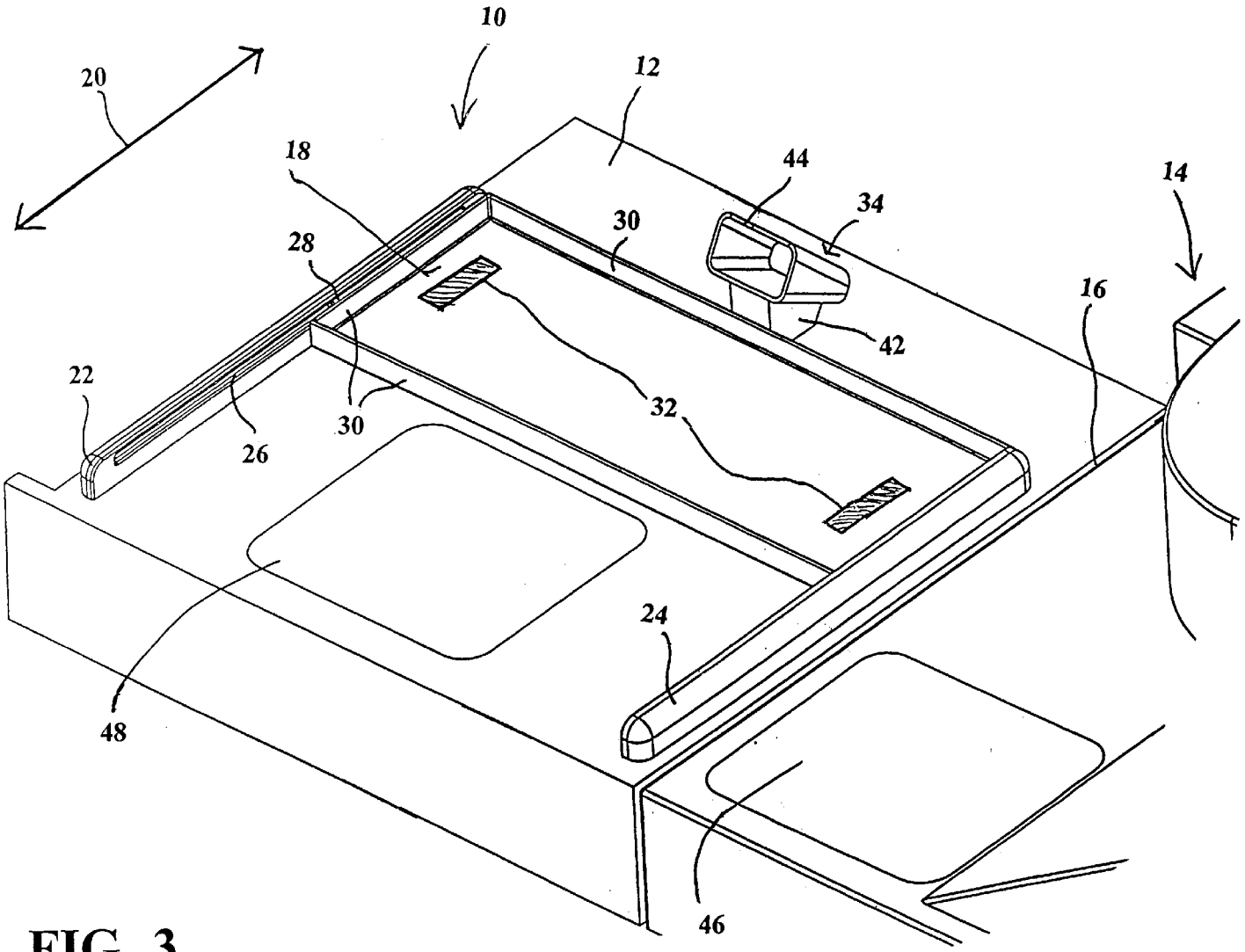
FIG. 3 is a top side perspective view of the disclosed keyboard caddy of FIG. 1 in a rearward position.

In the preferred embodiment, the mouse holster 34 may be attached to one of the side walls 30 such that the mouse holster 34 rides with the caddy base 18. As the caddy base 18 is moved to be in a selected one of a plurality of longitudinal positions, the mouse holster 34 moves accordingly, as shown in FIGS. 1 and 3. Thus, the mouse may be docked in the mouse holster 34 when not in use, and the mouse is carried by the mouse holster 34 when the mouse holster 34 and the caddy base 18 are moved and positioned in another selectable longitudinal position on the copier 14. The docking of the mouse in the mouse holster 34 prevents the mouse from being misplaced or inconveniently placed away from the keyboard in the keyboard caddy 10 when the mouse is not in use, such as during movement of the keyboard caddy 10.

The docking of the mouse in the mouse holster 34 also prevents the connecting wires between the mouse and the copier 14 from interfering with the movement of the caddy base 18, in that the mouse wire or tail extends rearward, as described below.

Figure 4:
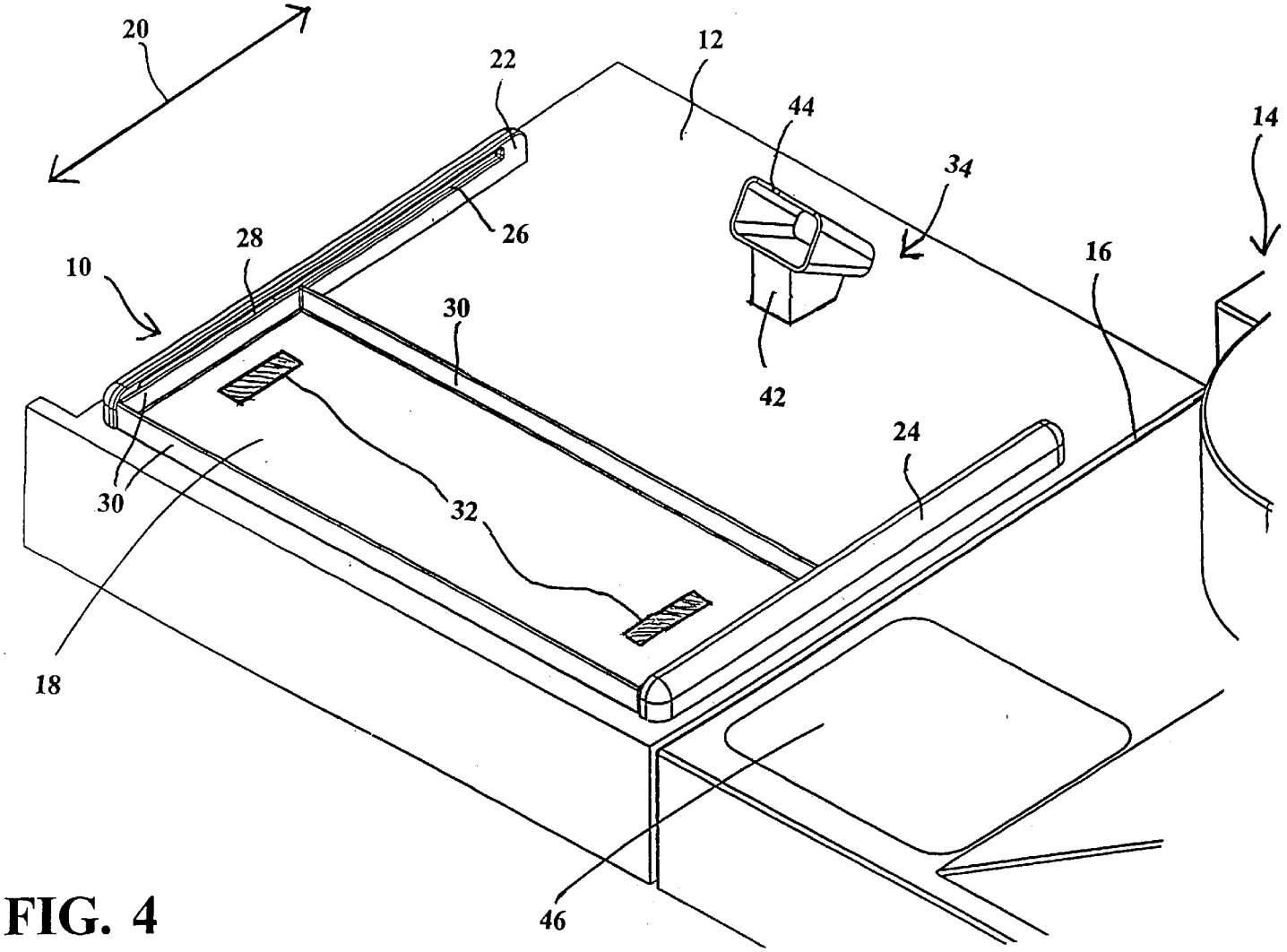
FIG. 4 is a top side perspective view of an alternative embodiment of the disclosed keyboard caddy of FIG. 1.

Alternatively, as shown in FIG. 4, the mouse holster 34 may be mounted in a fixed position on the top cover 12 of the copier 14 so that the mouse may be docked therein, independent of movement of the caddy base 18. Thus, the mouse holster 34 may be provided with or without the keyboard caddy 10, and also may be manufactured with the copier 14 and/or the top cover 12, independent of the keyboard caddy 10.

Figure 6:
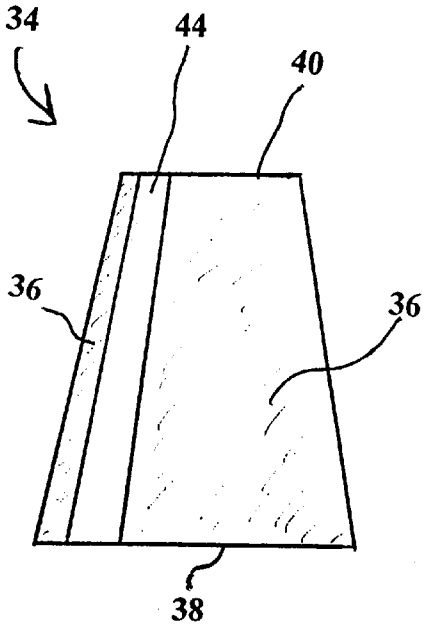
FIG. 6 is a top plan view of the mouse holster of FIG. 5.
Figure 5:
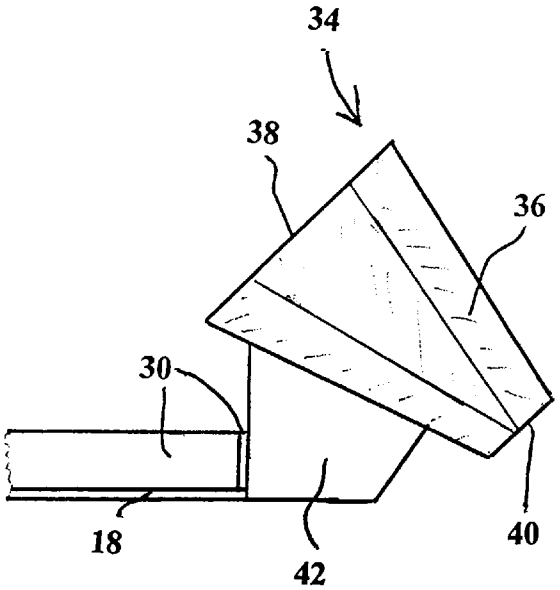
FIG. 5 is a side plan view of a mouse holster.

As shown in FIGS. 5–6, the mouse holster 34 has a tubular structure 36 which tapers from a first open end 38 to a second open end 40 which is smaller in width and height than the first open end 38. The tubular structure 36 is mounted on a holster base 42 to be oriented at an inclined angle; for example, at a 45° angle. The tapered and inclined configuration of the tubular structure 36 allows a mouse to be inserted into the first open end 38 and to move by the influence of gravity so that the body of the mouse rests against the inner tapered walls of the tubular structure 36. As shown in FIG. 5, in the preferred embodiment, the holster base 42 is attached to one of the side walls 30 of the keyboard caddy 10 to ride with the caddy base 18 as the caddy base 18 moves, as in FIGS. 1 and 3. Alternatively, the holster base 42 is mounted to the caddy base 18.

In another alternative embodiment, the holster base 42 is mounted to the top cover 12, as illustrated in FIG. 4 and described above.

As shown in FIG. 6 in conjunction with FIGS. 1 and 3–4, the tubular structure 36 includes an elongated slot 44 extending from the first open end 38 to the second open end 40, which allows the mouse wire or tail to be strung downward and through as the mouse is docked in the mouse holster 34. The mouse wire or tail then passes through the second open end 40 when the mouse body is positioned within the tubular structure 36, and so extends rearward, away from the keyboard caddy 10, which prevents interference in the movement of the keyboard caddy 10.

To remove the mouse from the mouse holster 34, the user grasps the mouse body, pulls the mouse body through the first open end 38, and removes the mouse wire from the second open end 40 by extending the mouse wire up and through the elongated slot 44.

The copier 14 may include a first mousepad 46 positioned on a top surface to allow a user to manipulate the mouse when the keyboard caddy 10 has the caddy base 18 and a keyboard resting thereupon in a frontward position, as shown in FIGS. 1 and 4, to provide a worksurface adjacent to the keyboard. When the keyboard on the caddy base 18 is oriented in a rearward position, as shown in FIG. 3, a worksurface is created in front of the keyboard between the rails 22, 24.

A second mousepad 48 may be optionally provided and positioned in the worksurface, for example, during manufacture of the copier 14, to allow the use of a mouse by right-handed or left-handed operators. The caddy base 18 may be positioned within the rails 22, 24 and configured and dimensioned such that the underside of the caddy base 18 is sufficiently high enough over the top cover 12 so that the underside does not contact the second mousepad 48, and so the second mousepad 48 does not impede the movement of the caddy base 18 to selectable positions.

Alternative to or in conjunction with the height of the underside of the caddy base 18 over the top cover 12, the second mousepad 48 may be positioned in a recess of the top cover 12 so as to avoid impeding the movement of the caddy base 18.

During jam clearance and recovery with the copier 14, the top cover 12 may be raised without disturbing the position of the keyboard relative to the top cover 12. When the keyboard is disposed on the caddy base 18 within the side walls 30, inclination of the top cover 12 causes a shifting of the keyboard, but the side walls 30 capture the keyboard to stay within the keyboard caddy 10. The mouse may be secured in the mouse holster 34, so that raising the top cover 12 does not cause the mouse to slide and/or be misplaced.

The fixed rails 22, 24 of the keyboard caddy 10 may secure the caddy base 18 therebetween in a selected position using, for example, a ratchet-and-pawl arrangement between the rails 22, 24 and the elongated protrusions, such as protrusion 28. Thus, raising the top cover 12 does not cause the keyboard caddy 10 with the keyboard therein to slide, via gravity, out of a pre-selected position chosen by a user for ease of use.

While the disclosed keyboard caddy is particularly shown and described herein with reference to the preferred embodiments, it is to be understood that various modifications in form and detail may be made without departing from the scope and spirit of the present invention. Accordingly, modifications such as any examples suggested herein, but not limited thereto, are to be considered within the scope of the present invention.

The invention has been described in detail with particular reference to certain preferred embodiments thereof, but it will be understood that variations and modifications can be effected within the spirit and scope of the invention.

Parts List

10 keyboard caddy
12 top cover
14 copier
16 gap
18 caddy base
20 arrow
22 rail
24 rail
26 slot
28 elongated protrusion
30 side walls
32 hook-and-loop fasteners
34 mouse holster
36 tubular structure
38 first open end
40 second open end
42 holster base
44 elongated slot
46 first mousepad
48 second mousepad

What is claimed is:

1. A keyboard caddy comprising:

a caddy base; a rail adapted to be located on a surface of a machine for holding a keyboard; said caddy base being slidably mounted on said rail to enable said caddy base to be movable to selected ones of a plurality of positions relative to said rail, said caddy base having an elongated protrusion extending laterally therefrom and slidably engaging a slot in said rail for locating said caddy base on said rail in a selected one of such plurality of positions; a mousepad located in a fixed position relative to said rail, wherein when said caddy base is in a first position said caddy base covers said mousepad, and said mousepad is exposed when said caddy base is in a second position.

2. The keyboard caddy of claim 1 further comprising:

a plurality of side walls mounted to the caddy base for forming a cavity in which the keyboard is positioned.

3. The keyboard caddy of claim 1 further comprising:

holding means mounted to the caddy base for removably securely holding the keyboard to the caddy base.

4. The keyboard caddy of claim 3 wherein the holding means includes hook-and-loop fasteners.

5. The keyboard caddy of claim 1 further comprising:

a mouse holster for holding a computer mouse input device.

6. A keyboard caddy for positioning a keyboard on a top cover of a copier comprising:

a pair of rails, having slots defined therein, said pair of rails being adapted to be mounted upon the top cover;

a caddy base including:

a planar surface upon which a keyboard is adapted to be positioned;

a plurality of side walls between which such keyboard is adapted to be positioned;

a pair of protrusions extending laterally from a pair of side walls of said plurality of side walls and slidably engaging said slots of said pair of rails to allow the caddy base to be moved to a selectable one of a plurality of positions relative to said pair of side rails; and a mousepad located in a fixed position relative to said pair of rails, wherein in a first position of said plurality of positions of said caddy base, said caddy base covers said mousepad, and said mousepad is exposed when said caddy base is in a second position of said plurality of positions.

7. The keyboard caddy of claim 6 further comprising:

holding means mounted to said planar surface for securely holding the keyboard to said planar surface.

8. The keyboard caddy of claim 7 wherein the holding means is a set of hook-and-loop fasteners, for removably engaging corresponding hook-and-loop fasteners mounted to an underside of the keyboard to removably secure the keyboard to the planar surface.

9. The keyboard caddy of claim 6 further comprising:

a mouse holster for holding a computer mouse input device.

10. The keyboard caddy of claim 6 further comprising: a mouse holster adapted to be mounted to the top cover of the copier.

* * * * *